United States Patent [19]

Tamietti

[11] Patent Number: 4,867,276

[45] Date of Patent: Sep. 19, 1989

[54] FAST-LOWERING HYDRAULIC EQUIPMENT

[76] Inventor: Paulo A. Tamietti, Rua Artur Itabirano, 360/34, Belo Horizonte-MG, Brazil

[21] Appl. No.: 224,547

[22] Filed: Jul. 26, 1988

[30] Foreign Application Priority Data

Aug. 3, 1987 [BR] Brazil ..... 6701566

[51] Int. Cl.[4] ..... A62B 1/12

[52] U.S. Cl. ..... 182/233; 182/42; 182/238

[58] Field of Search ..... 182/233, 235, 238, 5

[56] References Cited

U.S. PATENT DOCUMENTS

| | | | |
|---|---|---|---|
| 4,437,546 | 3/1984 | Marinoff | 182/233 |
| 4,452,430 | 6/1984 | Kankkunen | 182/233 |
| 4,480,716 | 11/1984 | Soubry | 182/238 |
| 4,554,997 | 11/1985 | Sheu | 182/233 |
| 4,655,327 | 4/1987 | Tomioka | 182/233 |
| 4,688,659 | 8/1987 | Sheu | 182/238 |
| 4,722,422 | 2/1988 | Hiraoka | 182/238 |
| 4,781,269 | 11/1988 | Clay | 182/233 |

*Primary Examiner*—Reinaldo P. Machado

*Attorney, Agent, or Firm*—Bryan, Cave, McPheeters & McRoberts

[57] ABSTRACT

A fast-lowering hydraulic equipment is described, fully automatic (10) which includes a box (11) with two chambers (12, 13) separated by a partition wall (14) where a central supporting shaft (19) is arranged. A chain (42), rope (71) or steel cable (66) with safety belt (80, 85) working on a pulley (30 or 72) or spool (65), drives a gear device (34, 35, 39, 40), amplifying the rotation at the central shaft (19) which, in its opposite end presents a propeller with blades (24) submerged in the oil chamber (12), retarding thus the lowering speed.

The hydraulic equipment in reference is adequate to be used in rescuing, maintenance or other jobs at any height, at the facade of buildings or similar situations, and may be stored in a sealed deposit box (140) for equipment protection, attached to the wall at strategic sites, propitiating higher safety in tall buildings and constructions.

15 Claims, 17 Drawing Sheets

FAST-LOWERING HYDRAULIC EQUIPMENT

This invention relates to a fast-lowering hydraulic equipment and, more specifically, to a small-size, automatic-braking device, adequate for utilization when collectively saving or rescuing one or more individuals simultaneously, in emergency situations, such as fires, upon the utilization of a belt or chair for user's accomodation. Moreover, the equipment object of the present invention can be utilized with high effectiveness, safety and practicality in other circumstances, such as maintenance or cleaning jobs in building facades.

According to the present invention, a fast-lowering hydraulic equipment includes basically a device consisting of a loose chain or rope, or with two ends, rotating on a sprocket in the case of chain or on a V-pulley in the case of rope, which, on its turn, drives a set of gears, the amplification force of which returns to the central shaft, supplying high rotation to a propeller with perpendicular blades submerged in an oil chamber, making it possible to decrease the constant lowering speed down to the ground. At the same time, at the opposite side, the chain or rope shall rise up to the device, which shall make it possible to simultaneously lower objects and individuals.

The automatic-braking propeller of the device of this invention was designed with the purpose of allowing the fall to be retarded, maintaining a constant, given speed. In addition, the equipment allows for supporting chain or rope displacement in any direction, making it possible for the user to utilize any end of the chain or rope.

The fast-lowering hydraulic equipment, according to the invention, is provided with safety belts with fast-coupling snap hook, which makes it possible to fast couple it to the chain at any point of same, involving the ring at any level, and a chair with safety belt for maintenance work.

The equipment in reference provides innovations such as chains or ropes, a hydraulic braking system, the fact that another user can climb/lower without it being required to retract the cables.

The equipment can be alternatively manufactured as follows:

a—With spool and steel cable, constituting an individual utilization equipment.

b—With stopping braking by means of a double external lever driven by two small ropes for purposes of stopping or releasing.

In addition, the fast-lowering hydraulic equipment, according to the present invention, can be utilized at any level, constituting thus a better improved and more practical and effective equipment when compared to the patent applications MU 6201796, of Nov. 23, 1982, under the name "FAST-LOWERING EQUIPMENT"; MU 6401699, of Oct. 16, 1984, under the name "ARRANGEMENT INTRODUCED INTO A FAST-LOWERING DEVICE"; and MU 6602129, of Oct. 31, 1986, under the name "EQUIPMENT FOR RESCUING IN BUILDINGS".

Other purposes, advantages and aspects of the present invention can be more easily understood in the following description, when read jointly with the drawings herewith enclosed, in which.

Figure 1:
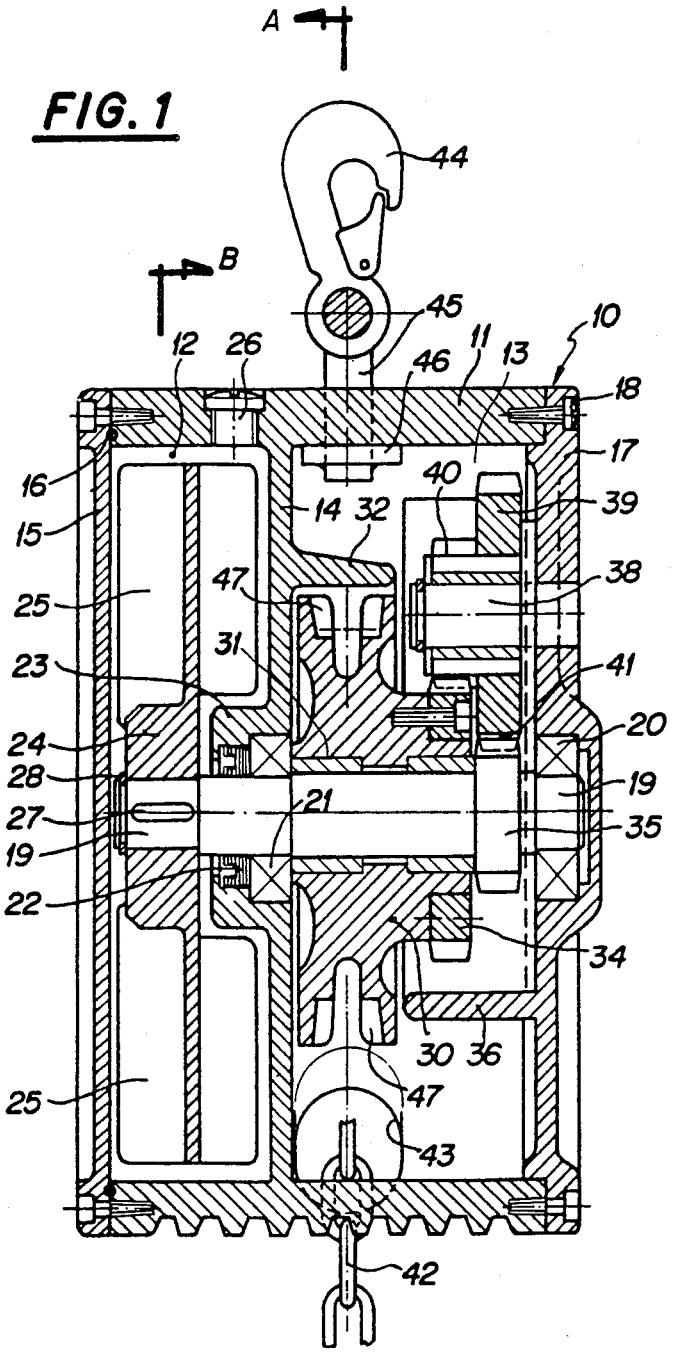
FIG. 1 represents a cross-section view of the fast-lowering hydraulic device, according to the present invention, showing the automatic hydraulic braking set.

As it may be inferred from the drawings herewith enclosed which illustrate and integrate this specification, a fast-lowering hydraulic equipment for situations of salvaging, maintenance, cleaning or similar, in buildings, according to the present invention, indicated in general in 10, on FIG. 1, includes basically a carcass 11 in the shape of a box, usually cylindrical, inside which a first chamber 12 is formed, separated from a second chamber 13, larger, by means of a partition wall 14. The box 11 is closed, on one side, by a cover 15, with rubber ring 16 for purposes of sealing, being closed on the other side by a cover 17, attached on position by means of appropriate screws or bolts 18. The partition wall 14 forms a central passage where a central supporting shaft 19 is provided, which is mounted on roller bearings 20, 21, having a retainer 22 provided behing the bearing 21, which is arranged in a cube 23 formed at the center of the partition wall 14. The central supporting shaft 19 has mounted in its left end, in relation to FIG. 1, a propeller 24 with perpendicular blades 25, which is arranged inside the chamber 12, usually filled with oil, which is introduced through an upper opening closed by means of the threaded plug 26. The propeller 24 is keyed to the shaft 19 by means of a key 17 and an elastic ring 28.

The central supporting shaft 19 receives, arranged inside the chamber 13, a sprocket 30, which is locked to the shaft by means of bushes 31 and is protected by means of a safety guide rib 32, formed at said partition wall 14. In front of the sprocket 30 is mounted a gear 34 and, in front of the latter, mounted to the central supporting shaft 19, is designed a second gear 35, remaining the gears 34 and 35 protected by means of a safety guide rib 36, formed at the internal side of the front cover 17.

The cover 17 has mounted in the internal side and at the top section, through a shaft 38, a double gear 39, whose small-diameter portion 40 has its teeth engaged to the teeth of the front gear or second gear 35.

The sprocket 30 is adequate to receive a chain 42 which wirks around the sprocket and through the passage openings 43.

The set 10 includes in its top portion a hook 44 for hoisting, which is attached to the box 11 by means of a handle 45 with internal reinforcement plate 46. The rings of the chain 42 engage into the cavities 47 of the sprocket 30, so that the displacement of the chain 42 causes the rotation of the sprocket 30, the central supporting shaft 19 and the propeller 24. Braking on the sprocket 30 is propitiated by the transmission between the gears 34, 35, 39, 40, when the amplification force of same returns to the central shaft 19, propitiating the high rotation of the propeller 24, with the perpendicular blades 25 submerged in the oil of the chamber 12, retarding thus the constant lowering speed (or the displacement speed of the chain 42).

Figure 4:
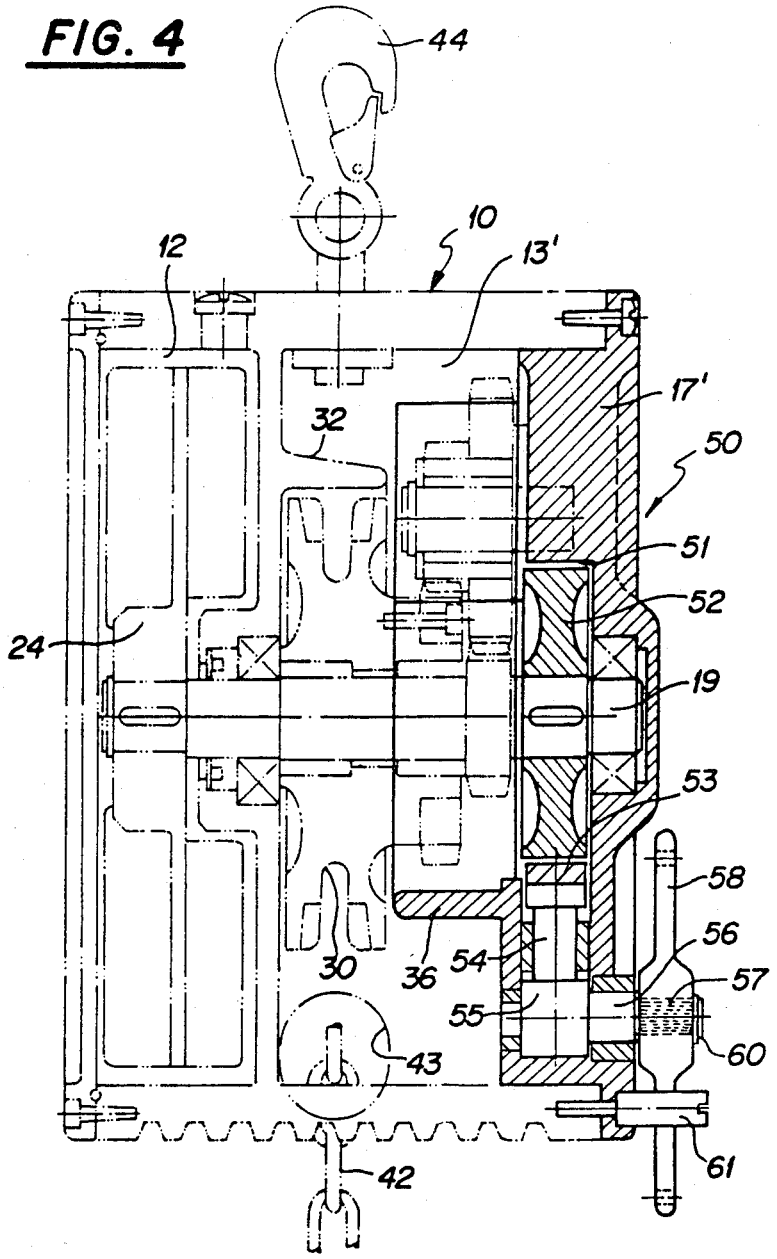
FIG. 4 represents a cross-section view similar to FIG. 1, showing the stopping braking system.
Figure 5:
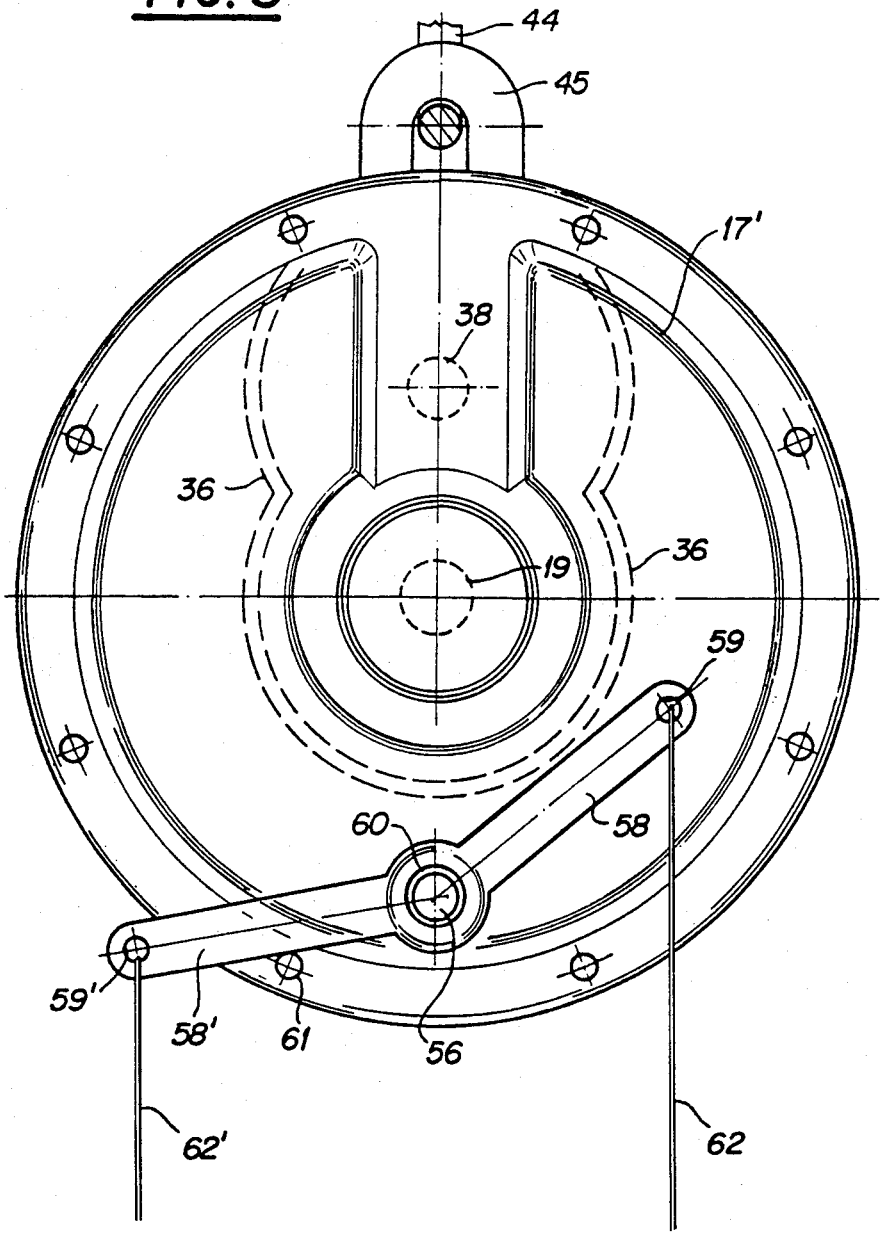
FIG. 5 represents a front view, taken from the right-hand side of FIG. 4, of the set in reference with stopping brake.

FIGS. 4 and 5 illustrate a variation of the invention, whose difference in relation to the previous arrangement lays in the inclusion of a stopping brake, indicated in general in 50 on FIG. 4. As it may be observed on this figure, the front cover 17' of the chamber 13' is slightly thicker than the cover 17 of the device of the previous configuration, so as to define a cavity 51 where is lodged a smooth braking pulley 52, appropriately keyed to the tip of the central supporting shaft 19 of the set. The cavity 51 is provided, below the smooth braking pulley 52, with a brake show 53, mounted at the top end of a pin 54, whose opposite or lower end leans onto the surface of an eccentric 55, solidary to a shaft 56, usually parallel to the central supporting shaft 19, and whose free end passes by a through hole provided at the lower portion of the cover 17' of the chamber 13'. The external portion of the shaft 56 is provided with regulation ribs 57 which make it possible to receive in an appropriate position a double lever 58, 58', provided with through holes 59, 59' close, respectively, to the free ends of the levers, such as represented clearly on FIG. 5. An elastic ring 60 attaches said double lever 58 to the tip of the eccentric shaft 56 and a return stop 61, appropriately arranged, limits the displacement of the double lever 58. A pair of small ropes 62, 62' are strung to the holes 59, 59' provided at the tips of the levers 58, 58'.

Figure 2:
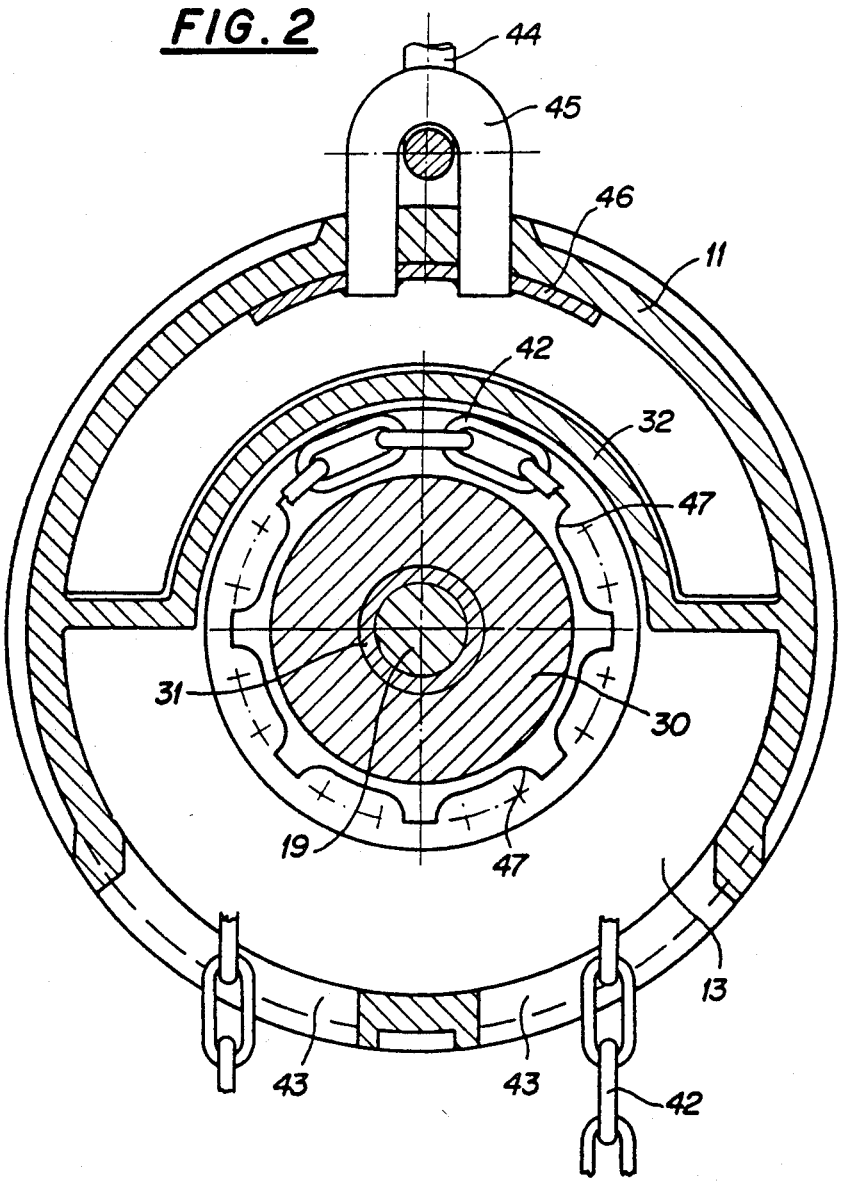
FIG. 2 represents a cross-section view of the device, according to the cutting line "A" on FIG. 1, showing the set of sprocket for chain.
Figure 3:
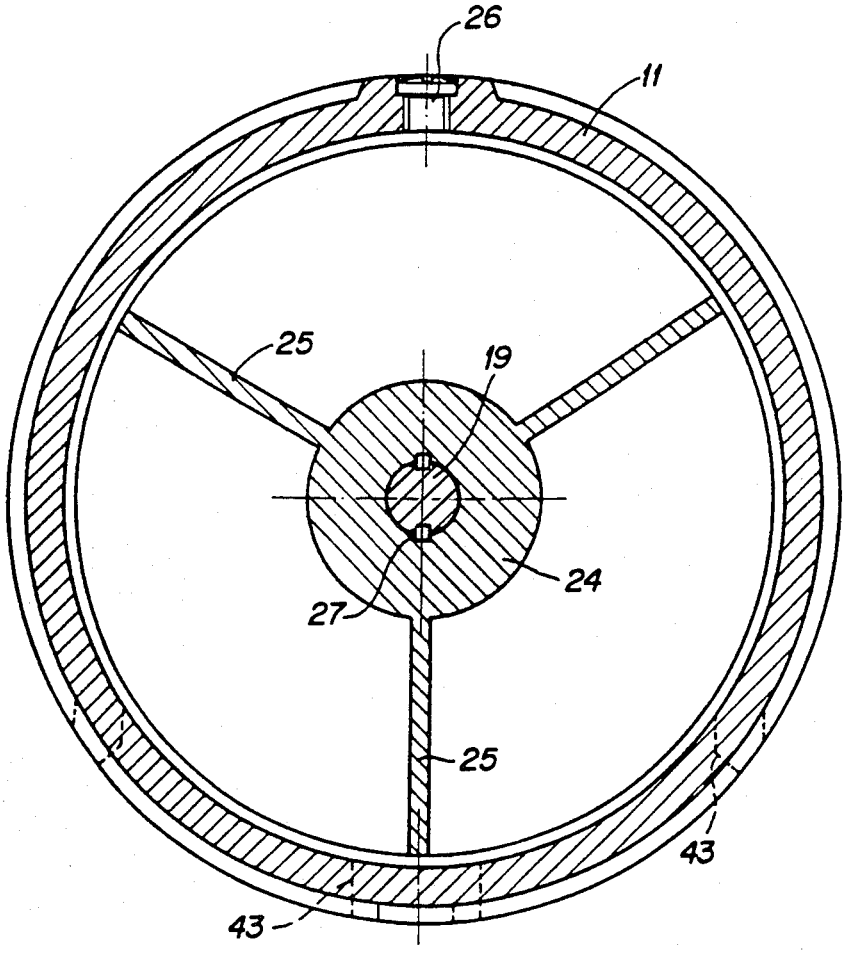
FIG. 3 represents a cross-section view, according to the cutting line "B" on FIG. 2, showing the set of propellers with perpendicular blades.

In the other components, the configuration illustrated on FIGS. 4 and 5 is similar to the configuration of the invention illustrated on FIGS. 1, 2 and 3.

Figure 6:
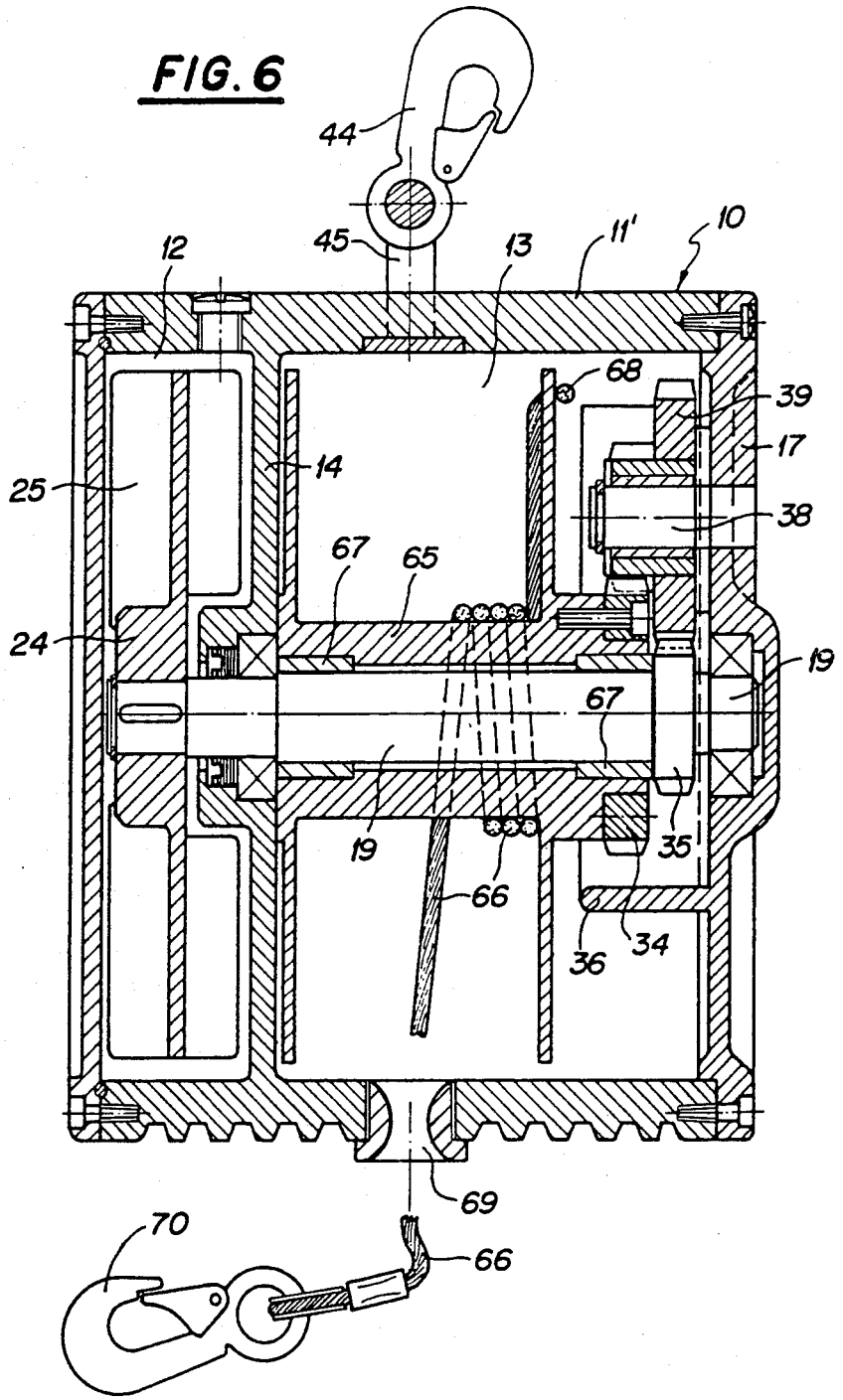
FIG. 6 represents a cross-section view taken longitudinally of the device, in which the set is adequate for operation with spool and steel cable.

FIG. 6 illustrates another variation of the configuration of the invention relating to an individual salvaging equipment in which, instead of a chain, a steel cable is utilized. As illustrated on FIG. 6, the carcass 11', built preferentially in a cylindrical shape, appears slightly longer than the carcass 11 of the previous configurations, so as to make it possible to lodge inside it a spool 65 where the steel cable 66 is strung. The spool 65 is arranged inside the chamber 13 and mounted by means of bushes 67 onto the central supporting shaft 19, in which are mounted the propeller 24 with perpendicular blades 25, inside the oil chamber 12, and the gear 35, in front of the large-diameter gear 34, which is attached to the tip of said spool 65. The end of the steel cable 66 is attached in 68 to the spool 65 and at the lower portion of the carcass 11' is provided an opening 69 as outlet of the steel cable 66, in whose free end is attached an appropriate hook 70.

Figure 7:
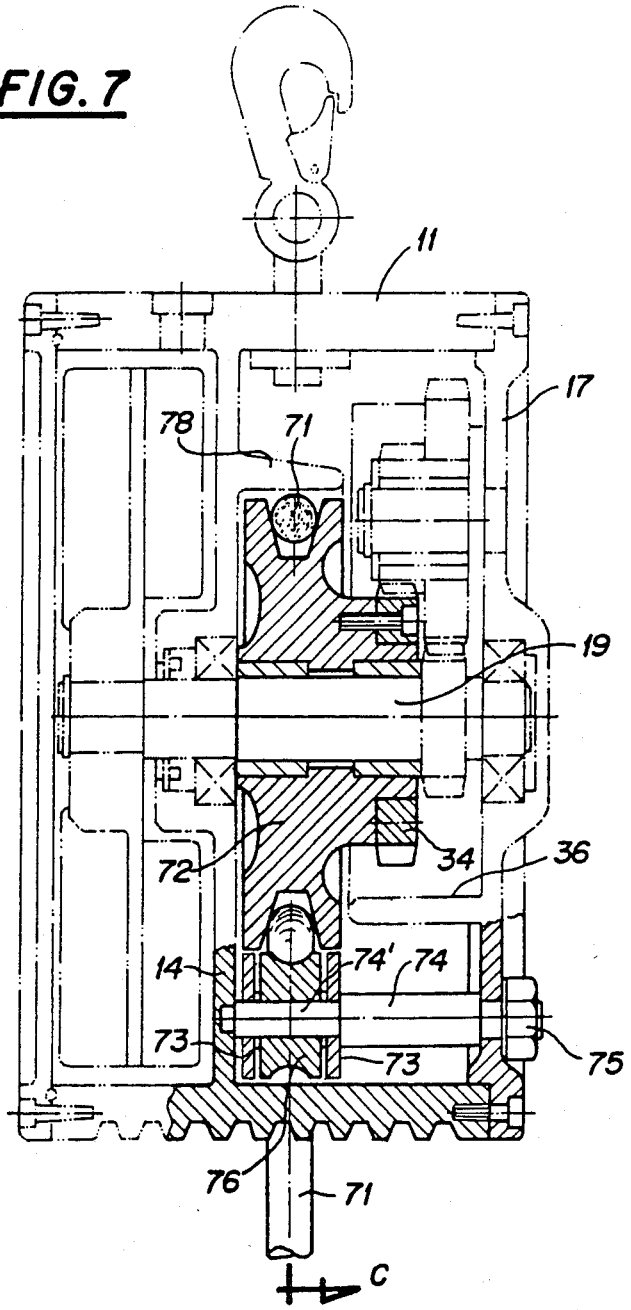
FIG. 7 represents a cross-section view similar to FIG. 1, but in which the device in reference is equipped with a V-pulley for rope.

The configuration illustrated on FIG. 7 is similar to that of FIGS. 1, 2 and 3, but, instead of a chain, it utilizes a rope 71 as its supporting element. At the central supporting shaft 19 is mounted a V-pulley 72, in which groove passes the rope 71. The displacement or passage of the rope 71 is controlled by means of a rocker arm 73 (refer to FIG. 8) attached on position by means of a fixed shaft 74. The fixed shaft 74 is arranged at the lower portion of the carcass 11, having an (internal) end mounted onto a hole located at the partition wall 14 of the set, and having the other end, threaded, attached by means of a nut 75 at the external side of the front cover 17 of the carcass. The fixed shaft 74 is provided with a recess 74' where are mounted the plates of the rocker arm 73 and a guide pulley 76, the latter being arranged between said plates of the rocker arm 73. As it may be observed on FIG. 8, at the ends of the plates of the rocker arm 73 are mounted two or three safety guide pulleys 77, 77'. The rope 71 works around the V-pulley 72 and between the two passages defined between the periphery of the central pulley 76 and the periphery of the respective safety pulleys 77 and 77', such as illustrated on FIG. 8. A safety guide rib 78 is arranged around the V-pulley 72, preventing the rope 71 from leaving the position. In the other parts, this configuration is similar to that of the invention as illustrated on FIGS. 1, 2 and 3.

The fast-lowering hydraulic equipment, previously illustrated and described with reference to FIGS. 1 thru 8 is used together with other components which are illustrated on the following figures and description relating to same.

Figure 9:
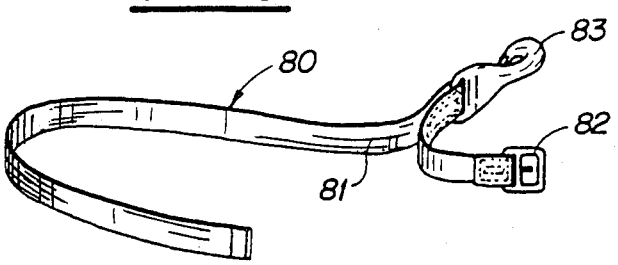
FIG. 9 represents a perspective view of the belt included with the alternative system with chair, for the equipment of this invention, when used for purposes of building facade cleaning or maintenance.
Figure 9:
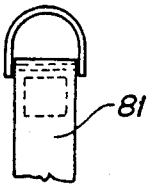
Figure 33:
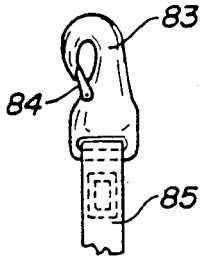
FIG. 33 represents a detail of the fast-coupling snap hook with safety lock.
Figure 10:
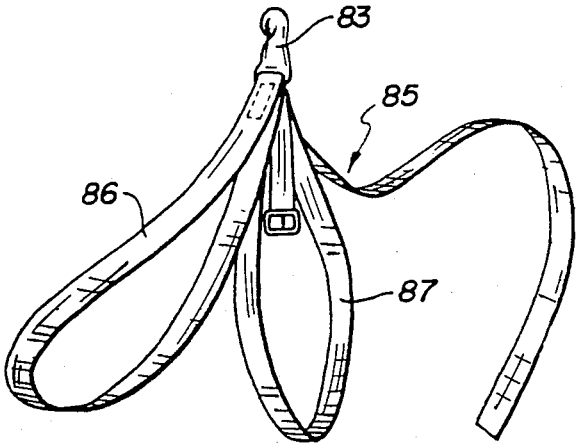
FIG. 10 represents a perspective view of the rescuing belt.

Thus, FIGS. 9 and 10 illustrate respectively a supporting belt and a rescuing belt with two handles, both provided with fast-coupling snap hooks. As illustrated on FIG. 9, the supporting belt 80 includes the belt itself 81, provided with buckle 82 and fast-coupling snap hook 83, provided with safety lock 84, as represented on FIG. 33. As it may be observed on FIG. 10, the rescuing belt 85 includes two handles 86, 87, adjustable, attached to a fast-coupling snap hook 83 and provided with safety lock.

Figure 17:
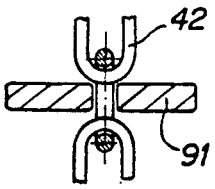
FIG. 17 represents a cross-section view, taken in the direction of the cutting line E—E on FIG. 16, showing a fast-coupling detail of the special double hook for chain.
Figure 18:
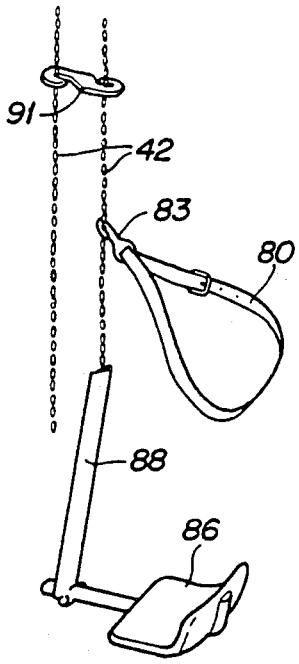
FIG. 18 represents a perspective view of the set with chair plus belt and special double hook.

FIGS. 18, 19, 20 and 32 illustrate examples of other complements utilized with the fast-lowering hydraulic equipment of the invention. On FIG. 18, a rescuing chair 86 is illustrated, adequate for attachment to the end of chain 42 or to any ring of the same by means of a tubular column 88, whose upper extremity includes a closing plate 89 with orifice or slot 42, which makes it possible to attach the chair 86 to the chain 42. The chain 42 is used with a special double hook 91, in which one side of the hook presents a cavity 92 with parallel sides and the other side apresents a cavity 93 with sharpened sides from the opening inwards. The rings of the chain 42 engage to the side 92 of the hook 91 and are maintained in the same by means of a safety lock 94, provided with a spring 95, the safety lock 94 being attached to the body of the special double hook 91 by means of the shaft 96. In the other side of the hook 93, the rings of the chain 42 may be engaged freely, such as represented on FIG. 17 of the drawings. These examples of supporting belt 80, rescuing belt 85 and rescuing chair 86, as well as of the complementary parts 88, 91, are merely illustrative of the means which can be utilized combined or individually jointly with the hydraulic devices previously described with reference to FIGS. 1 thru 8 of the drawings.

Figure 8:
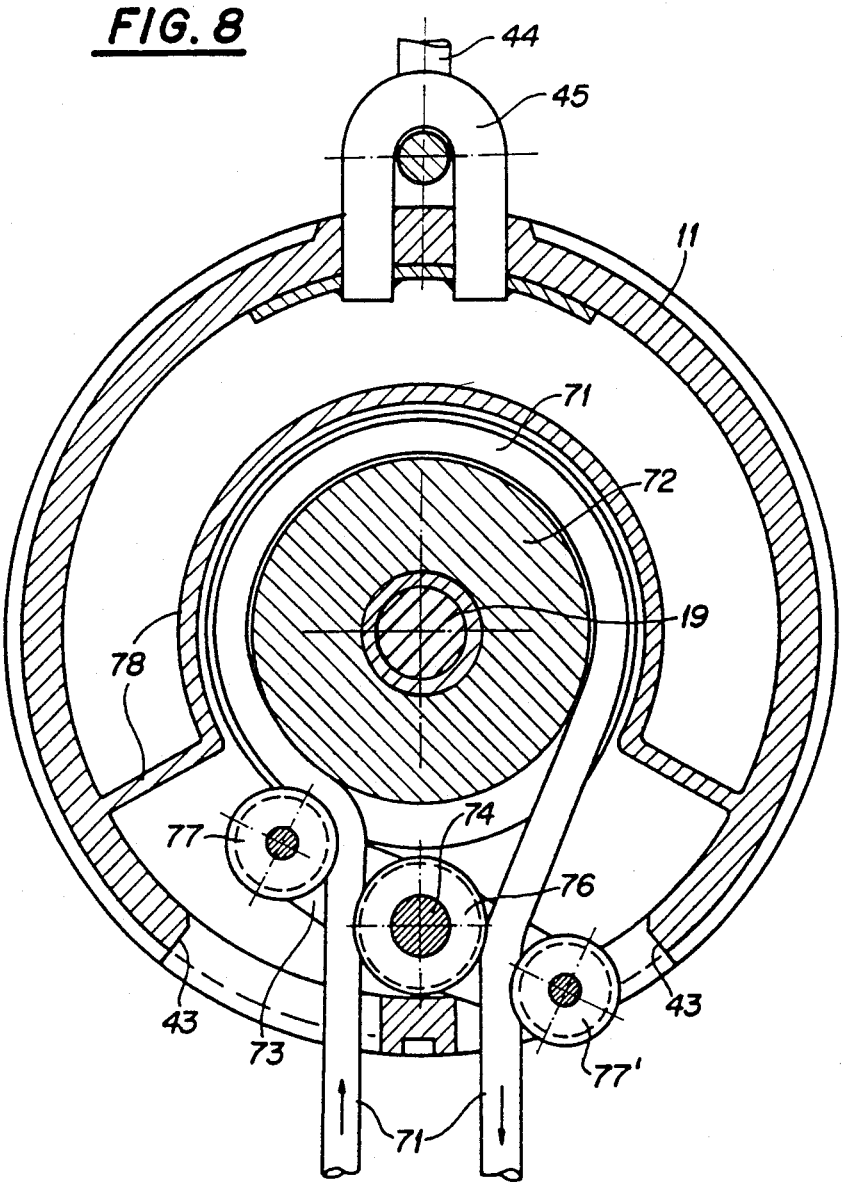
FIG. 8 represents a cross-section view taken in the direction of the cutting line "C" on FIG. 7, of the set of pulleys for rope.
Figure 32:
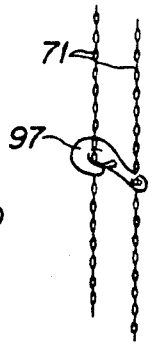
FIG. 32 represents a detail of the special stopping hook attached to the rope.
Figure 16:
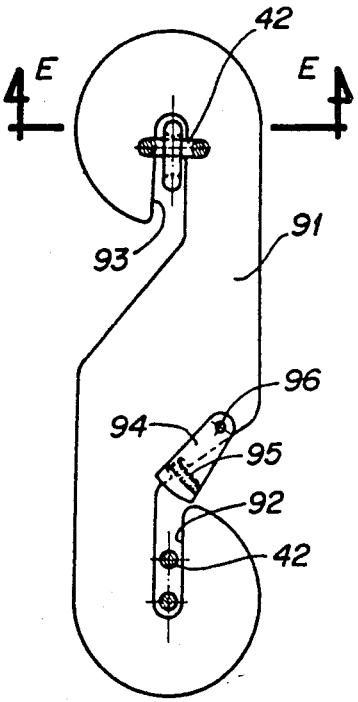
FIG. 16 represents a plane elevation view, showing a detail of a special double hook for stopping, attached to the chain.
Figure 19:
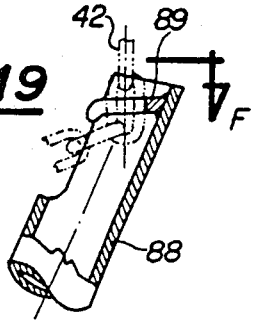
FIG. 19 represents a cross-section view of a detail of chair attachment to the chain of the hydraulic equipment in reference.
Figure 20:
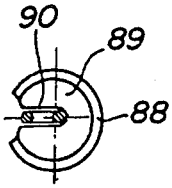
FIG. 20 represents a top plane view, taken in the direction of arrow "F" on FIG. 19.

On FIG. 32 a special hook 97 is also illustrated, adequate for stopping or halting jointly with ropes 71, when the configuration of the invention illustrated on FIGS. 7 and 8 previously described is utilized.

Figure 11:
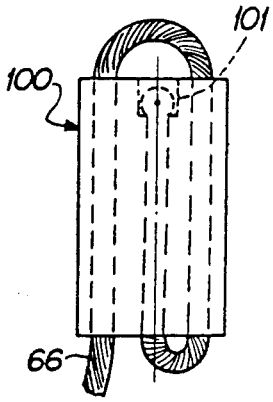
FIG. 11 represents a view of the fastener used at the end of the steel cable.
Figure 15:
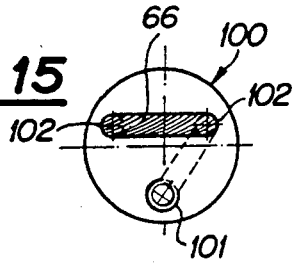
FIG. 15 represents a top plane view of FIG. 11.
Figure 24:
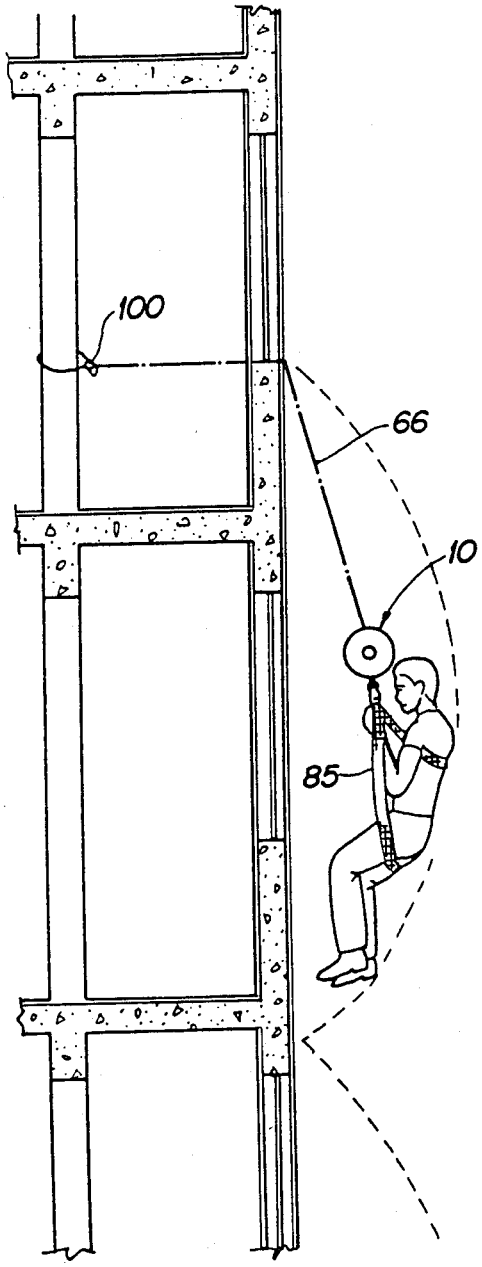
FIG. 24 represents a view of a utilization example, showing the user as he lowers close to a building facade, with the equipment attached to the supporting column by means of a fastener.

On FIGS. 11 and 15 is illustrated a configuration of steel cable tying, which consists of a fastener 100, which is adequate to fasten or attach the steel cable 66 to a column of a building, when the individual equipment of the invention is utilized, such as illustrated on FIG. 24, with rescuing belt 85. The fastener 100 is provided with a recess 101 for attachment of the end of the steel cable 66 and with orifices 102 for the passage of the cable 66, allowing thus the attachment of the same to any desired supporting point of the building from which the users are to be individually rescued.

Figure 12:
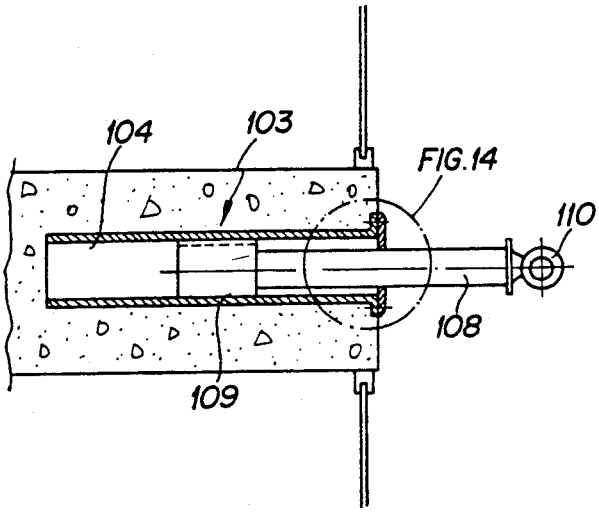
FIG. 12 represents a detail of the tuboscopic hook for equipment supporting, attached to the wall of the building where the fast-lowering hydraulic equipment is utilized.
Figure 14:
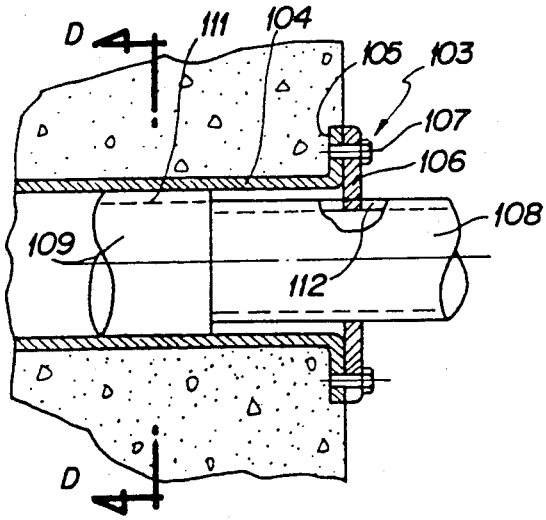
FIG. 14 represents a cross-section view, showing a detail of the stop in the tuboscopic hook of FIG. 12.
Figure 13:
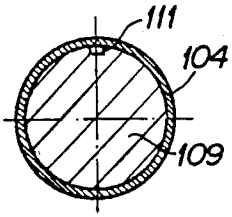
FIG. 13 represents a cross-section view taken in the direction of cutting lines D—D on FIG. 14, which shows the vent slot detail at the tuboscopic stem.

FIGS. 12, 13 and 14 illustrate an example of attachment or supporting point for the fast-lowering hydraulic equipment according to the invention. The set 103 includes a set of tuboscopic hook, formed by a tube 104 appropriately attached to the concrete, having an extreme flange 105 which receives another flange 106 attached by means of bolts 107 to the flange of the anchoring tube 104. Inside the anchoring tube 104 is arranged a tuboscopic stem 108 in whose internal end a piston 109 is designed and in whose external end a ring 110 (see FIG. 12) is formed. A slot 111 allows for the passage of air in the tuboscopic stem and a guide slot 112 allows the tuboscopic stem to be displaced longitudinally inside the anchoring tube 104, but prevents said stem 108 from oscillating inside the tube 104. With this configuration, the tuboscopic stem 108 can remain regularly retracted close to the wall of the building and be exteriorized in relation to the same, whenever necessary or when it is desired to utilize the hydraulic equipment 10 previously described.

Figure 21:
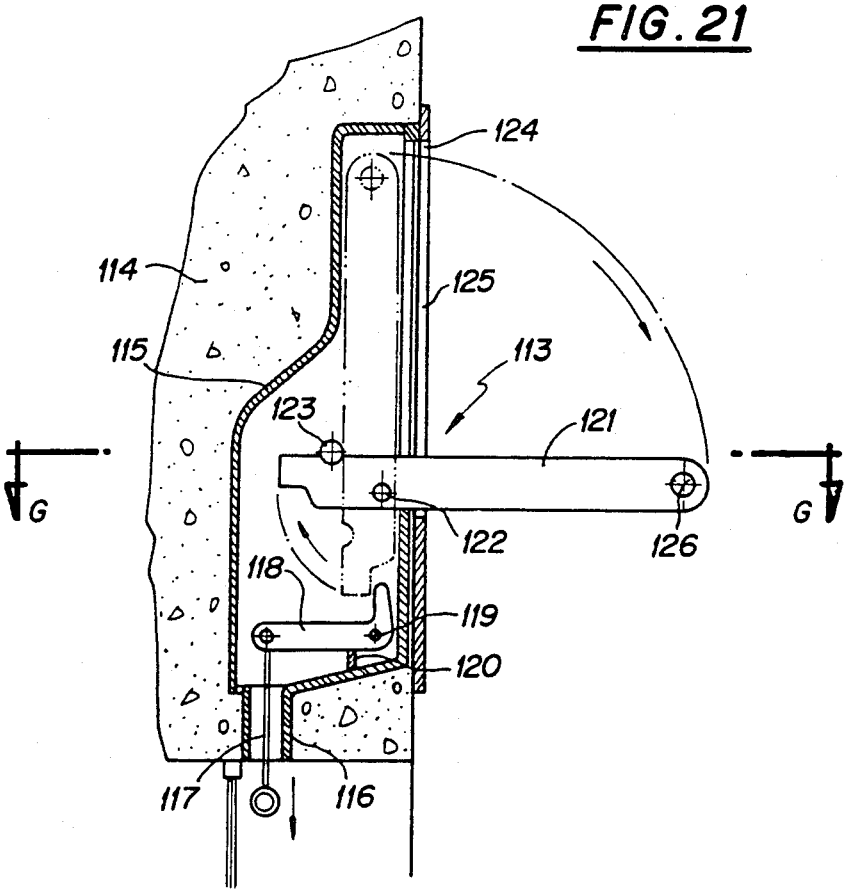
FIG. 21 represents a cross-section view, showing a detail of an automatic articulate hook attached to a building facade, for the support of the fast-lowering hydraulic equipment.
Figure 22:
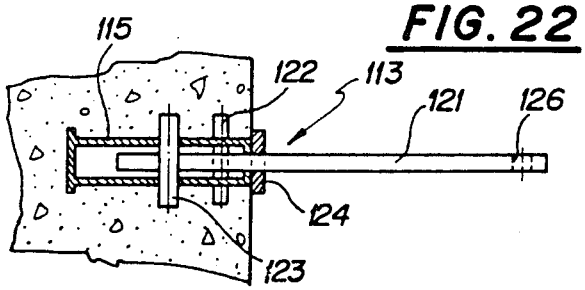
FIG. 22 shows a cross-section view taken in the direction of the cutting line G—G on FIG. 21.

FIGS. 21 and 22 illustrate another configuration of a device for anchoring the hydraulic equipment to the wall of a building or similar item. As exposed, this device has the shape of an automatic articulate hook 113, which is built-in in a cavity formed in the wall 114 of the building. The device 113 in reference includes a metalic box 115, having a lower passage 116 for a driving stem 117 ending in a ring. The driving stem 117 is attached to a driving lever 118 which articulates in a pin 119 against the action of a spring 120. An arm 121 articulates in a shaft 122 and, when in the exteriorized position illustrated in solid lines on FIG. 21, leans against a stop 123 arranged in the median region of the metallic box 115. A finishing plate 124 maintains the front of the box 115 closed, with the exception of a slot 125 for the passage of the arm 121, which presents at the free end an orifice 126 for engagement of the hook 44 of the rescuing equipment.

Figure 23:
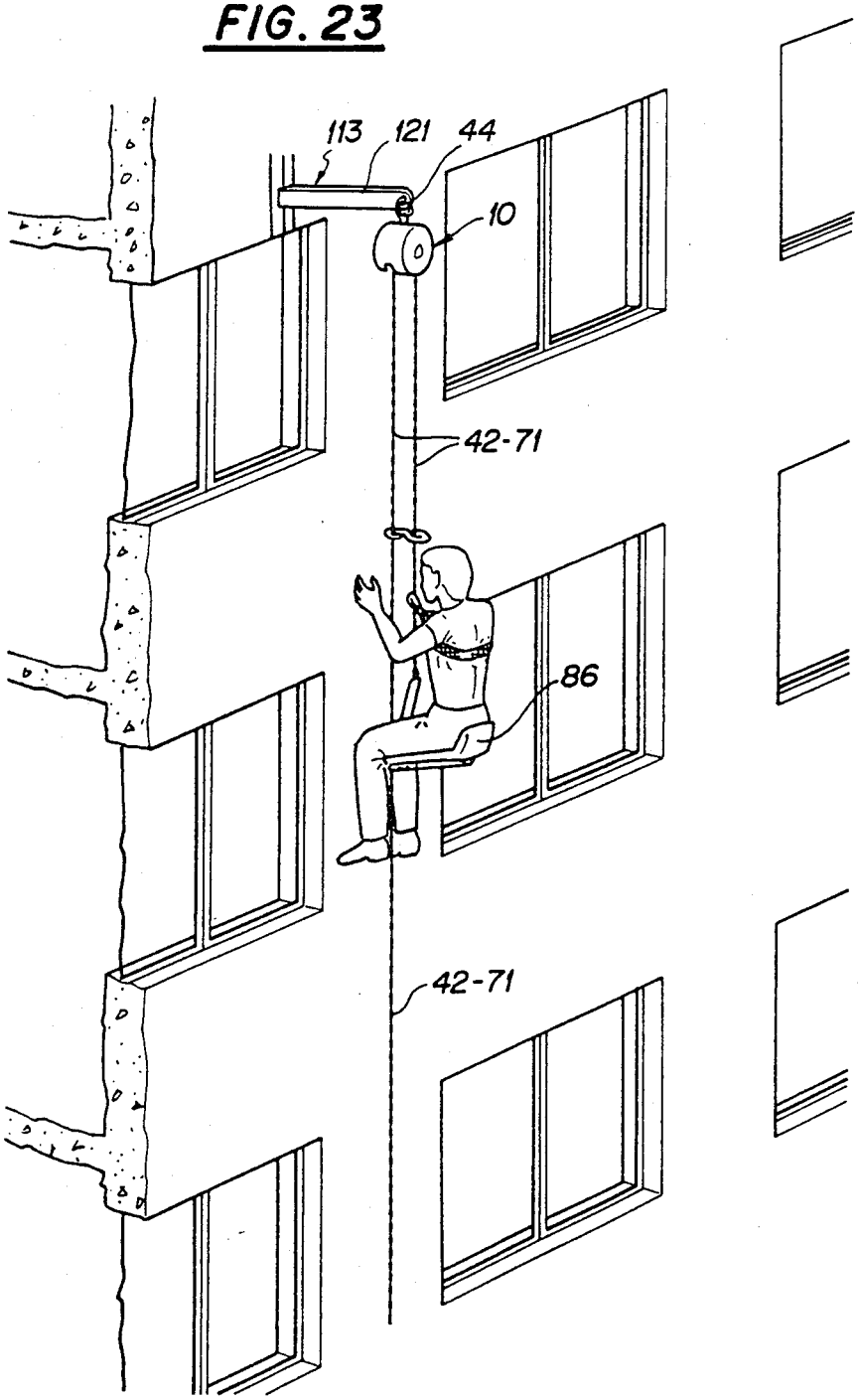
FIG. 23 represents a perspective view, showing a utilization example of the fast-lowering hydraulic equipment of this invention, when utilized for maintenance work in building facades.

FIG. 23 illustrates an example of utilization of the equipment according to the invention, in this case utilized in the maintenance of the building facade. The equipment 10 is attached by its hook 44 to the arm 121 of the set 113 previously described, and a chair 86 is utilized jointly with the chain 42, whose sides or sections are put together by means of the special hook 91, such as illustrated. The suspension element utilized with the apparatus 10 may be a chain 42 or a rope 71, and in this latter case a special stopping hook 97 shall be utilized, as described in relation to FIG. 32.

On FIG. 24 is illustrated the cross-section of a building, showing the user as he performs an emergency lowering operation with the individual utilization equipment 10, which is the type illustrated on FIG. 6, that is, provided with spool and steel cable 66. The steel cable 66 is tied by its end, through the fastener 100, to a column, piece of furniture or any other supporting point inside the building, so as to provide the desired attachment. The device 10 is utilized attaching the rescuing belt 85 by its snap hook to the hook of the device 10, and the user performs the lowering operation by unwinding the cable 66 from inside the spool lodged in the device 10.

Figure 25:
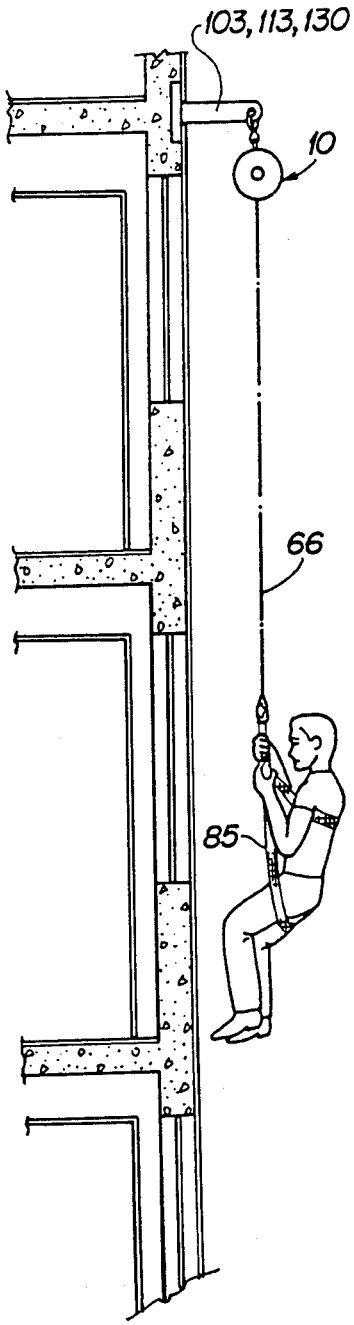
FIG. 25 illustrates a utilization example of the hydraulic equipment, when same is attached by means of a hook attached to a building facade.

FIG. 25 illustrates a variant of utilization the device 10 illustrated on FIG. 6, that is, of the fast-lowering hydraulic equipment 10 illustrated on FIG. 6, in which the user, attached to the rescuing belt 85, which is fastened to the steel cable 66, is lowered in front of the building, with the device 10 attached to a supporting point, which can be any one of the types illustrated on FIGS. 12, 13, 14 (tuboscopic stem 104, 108) or on FIGS. 27, 28 (described hereinafter).

Figure 26:
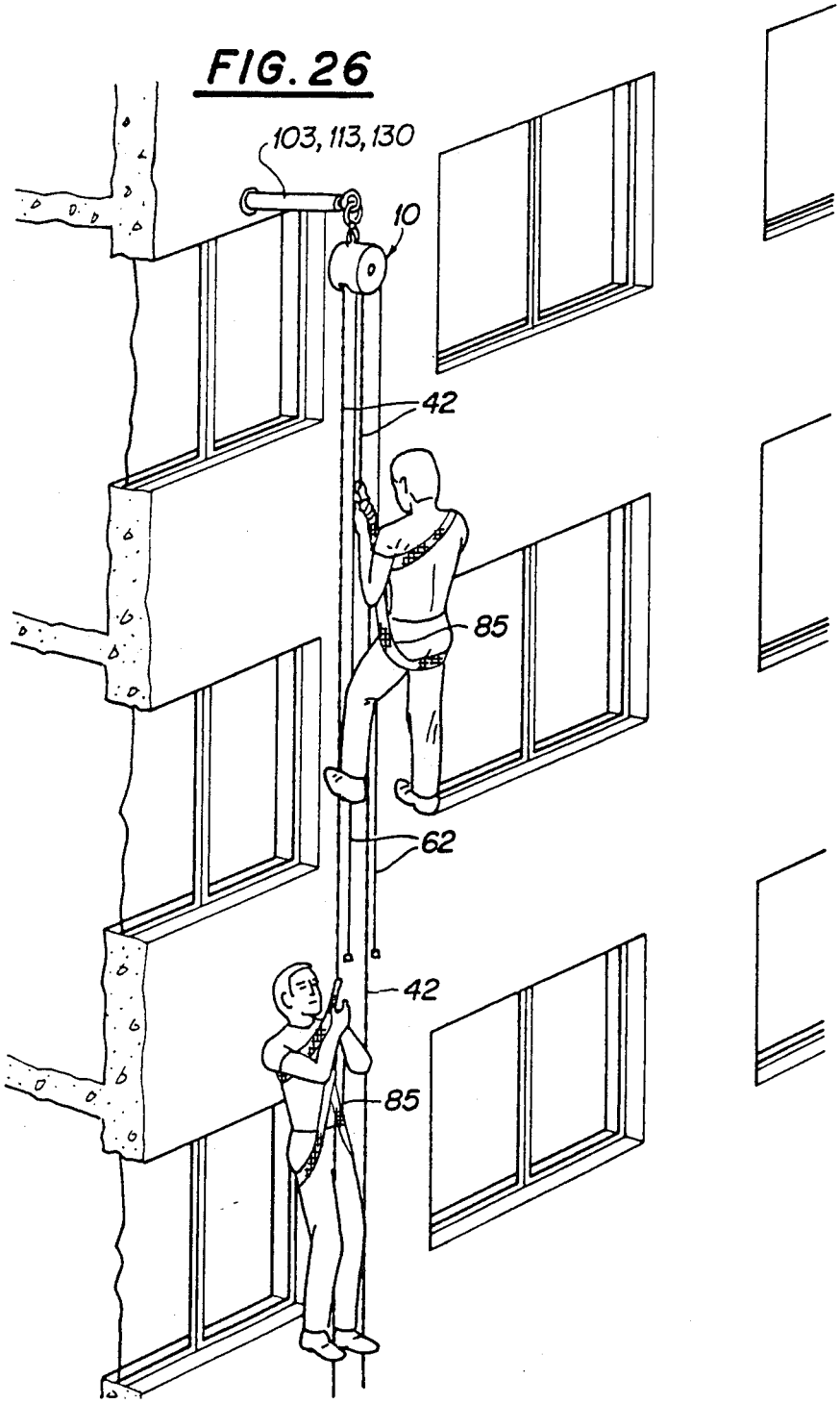
FIG. 26 shows a utilization example of the fast-lowering hydraulic equipment according to the invention, giving an example of how users perform simultaneous lowering and climbing for salvage/maintenance, with the equipment fastened to the hook attached to a building facade with a stopping braking device.

FIG. 26 illustrates an example of utilization of the hydraulic equipment according to the invention, of the device for chain illustrated on FIGS. 4 and 5, which includes the double lever 58, 58' for stopping braking control, which is driven by means of ropes 62, 62'. This device and this utilization are adequate for the performance of simultaneous lowering/hoisting, for purposes of rescuing or maintenance with collective rescuing equipment. The device 10 remains attached to a supporting device which may any one of the types illustrated on FIGS. 12, 13, 14 (device 103), on FIGS. 21, 22 (device 113) or on FIGS. 27, 28 (device 130).

Figure 27:
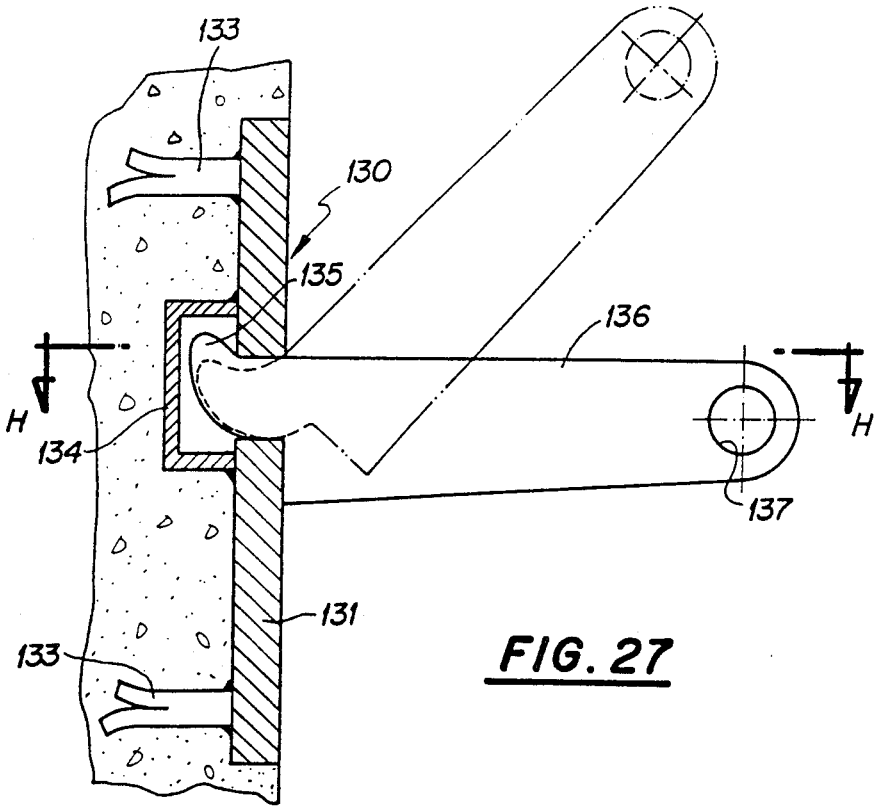
FIG. 27 represents a cross-section view, showing the arrangement of a retractible hook utilized to attach the hydraulic equipment to a building facade.
Figure 28:
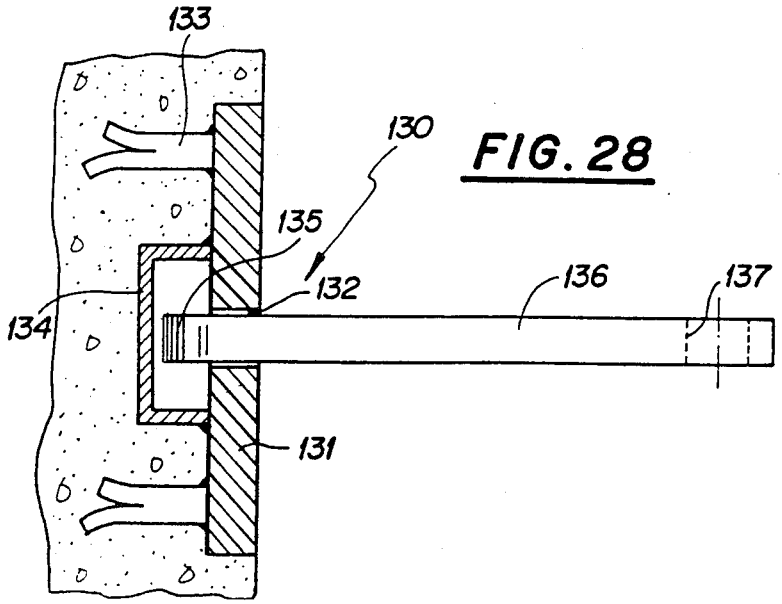
FIG. 28 represents a cross-section view, taken in the direction of the cutting line H—H on FIG. 27.

FIGS. 27 and 28 illustrate a variant of configuration for the supporting device of the hydraulic set 10, which is in the shape of a retractile hook 130. In this configuration, a supporting plate 131, provided with an anchoring opening 132, remains appropriately anchored to the wall of the building by means of pins 133 adequately attached to the concrete, such as illustrated. Behind the anchoring opening 132 is formed a box or drawer 134 which defines a space for engagement of the tipo of the anchoring arm 136. The tip of the anchoring arm 136 presents a portion curved upwards 135, which allows to maintain the arm 136 attached on position, leaned against the external face of the supporting plate 131, as clearly represented on FIG. 27. The anchoring arm 136 is provided with an orifice 137 in its free or external end, so as to be capable of receiving the suspension hook 44 of the apparatus 10.

Figure 29:
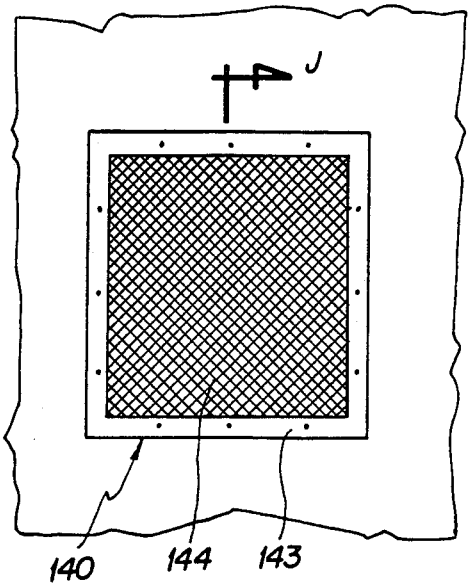
FIG. 29 represents a front elevation view of the deposit box utilized for the protection of the hydraulic equipment, duly sealed.
Figure 30:
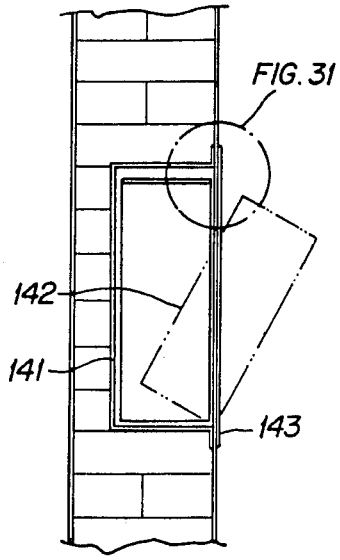
FIG. 30 represents a cross-section view of the equipment's deposit box, taken in the direction of the cutting line "J" on FIG. 29.
Figure 31:
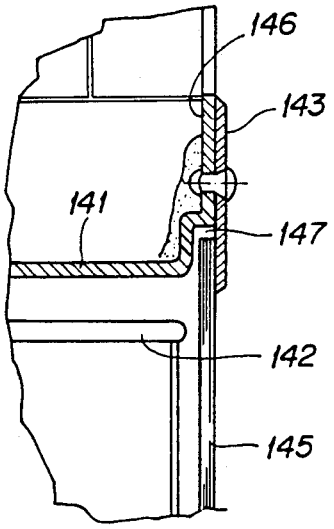
FIG. 31 represents a detail of FIG. 30, showing the attachment of the transparent glass of said deposit box for equipment protection.

On FIGS. 29, 30 and 31 is illustrated an example of configuration of a deposit box 140, appropriate for protection of the fast-lowering hydraulic equipment 10 previously described. This deposit box 140 remains attached to the wall of the building and includes a structure 141 where a removable box 142 is arranged for transportation of the equipment 10. The deposit box 140 includes a cover provided with frame 143, screen 144 and transparent glass 145.

As exposed on FIG. 31, the structure 141 of the deposit box is attached to the wall of the building, and the frame 143 is rivetted to the contour flange 146 of the structure 141. The transparent glass 145 remains lodged in a recess 147 of the structure 141 and the frame 143 sets around the glass, attaching the same firmly on position.

It shall be understood, naturally, that although the invention is illustrated and described in accordance with some preferred configuration shapes, it is susceptible of alterations and variations which shall promptly occur to those who are experient in the technique. It is intended, therefore, that all alterations and variations which may eventually adjust to the scope of the following claims be considered as replicas of the present invention.

I claim:

1. Fast-lowering hydraulic equipment, appropriate for individual and/or collective utilization, characterized in that it includes a housing (10) in the shape of a box, usually cylindrical, inside which is formed a partition wall (14) parallel to the longitudinal axis of the box and which defines a first chamber (12) on one side, and a second chamber (13) on the other, each one being closed by a respective cover (15, 17); a central supporting shaft (19) arranged inside the two chambers (12, 13) and receiving, on one side, a propeller (24) with perpendicular blades (25), and on the other, a pulley (30, 72) with a peripheral groove appropriate for engagement of a suspension element (42, 71); and a set of gears (34, 35, 39, 40) conjugated with the central supporting shaft (19), arranged so as to make return to the central shaft (19) the amplification force developed by the rotation of the pulley (30, 72) when a load is applied to the suspension element (42, 71); said housing being provided with a hook (44) in its upper portion, for engagement into an appropriate supporting device (103, 113 or 130) attached to the front wall of a building.

2. Fast-lowering hydraulic equipment, according to claim 1, characterized in that the first chamber (12) is a hermetic chamber with oil, with an opening provided with threaded plug (26) for oil feeding; the second chamber (13) provided with openings (43) for the passage of the suspension element (42, 71), characterized in that the partition wall (14) and the front cover (17) are provided, in adequate positions, with respective protection ribs (32 or 78, 36) which partially surround the pully (30, 72) on one side and the power transmission gears (34, 35) on the other.

3. Fast-lowering hydraulic equipment, according to claim 1, characterized in that the pulley (30) is a sprocket, provided with teeth or cavities (47) for engagement of chain rings, and that the suspension element (42) is a ring chain.

4. Fast-lowering hydraulic equipment, according to claim 1, characterized in that the pulley (72) is smooth with an annular incision in "V" and that the suspension element (71) is a rope or cable, a configuration of rocker arm (73) being provided with guide pulleys (76, 77), conjugated with the smooth pulley, so as to control the displacement or passage of the suspension element (71) around said smooth pulley (72).

5. Fast-lowering hydraulic equipment, according to claim 1, characterized in that the central supporting shaft (19) has a first gear (34) keyed, of larger diameter, conjugated with the pulley (30, 72), and a second gear (35) of smaller diameter ahead of the first, the second gear (35) being engaged to a third gear (39) of larger diameter which is mounted on a shaft (38) attached to the front cover (17) and ahead of which is arranged a fourth gear (40) engaged to said first gear of larger diameter (34).

6. Fast-lowering hydraulic equipment, according to claim 1, characterized in that a stopping brake (50) is provided, arranged at the front side of the device, and the central supporting shaft (19) includes, in addition of the sprocket (3) and ahead of the second gear of smaller diameter (35), a second pulley (52), smooth, against which acts a brake shoe (53) driven by a double lever (58, 58') which is controlled from outside by means of a pair of driving ropes (62, 62').

7. Fast-lowering hydraulic equipment, according to claim 1, characterized in that the suspension element (66) is a steel cable, to which a spool (65) is wound, which is keyed to said central supporting shaft (19), and that the first gear of larger diameter (34) is attached to the front side of said spool for cable (65).

8. Fast-lowering hydraulic equipment, according to claim 1, characterized in that attachment devices (80, 85) are provided, in the shape of safety and rescuing belts, with fast-coupling snap hook (83), attachable to said suspension elements (42, 66, 71).

9. Fast-lowering hydraulic equipment, according to claim 1, characterized in that a chair (86) is provided with column (88) adjustable to the suspension element (42).

10. Fast-lowering hydraulic equipment, according to claim 1, characterized in that a double hook (91) is provided for interconnection, in an appropriate position, of the two sections of the suspension element (42).

11. Fast-lowering hydraulic equipment, according to claim 1, characterized in that the supporting device (103) is the tuboscopic type, including a stem (108) provided with internal piston (109) which is displaced inside an anchoring tube (104) attached to the facade of the building.

12. Fast-lowering hydraulic equipment, according to claim 1, characterized in that the supporting device (113) has the shape of an automatic articulate hook (121) appropriate to remain regularly retracted in a housing (115) built-in in the facade wall of the building, including a device (117, 118, 119, 120) arranged so as to allow the release of the automatic articulate hook (121) when necessary.

13. Fast-lowering hydraulic equipment, according to claim 1, characterized in that the supporting device (130) has the shape of a retractile hook (136) which includes a turned-up tip (135) engageable in an opening (132) formed in a supporting plate (131) regularly attached to the facade of the building.

14. Fast-lowering hydraulic equipment, according to claim 1, characterized in that a deposit box (140) is provided to house the equipment (10) when the latter is not being used, said deposit box being formed by a structure (141), removable box (142), frame (143), screen (144) and transparent glass (145).

15. Fast-lowering hydraulic equipment, according to claim 1, characterized in that a special hook (97) is provided for stopping attached to the ropes (71) of the hydraulic device (10).

* * * * *

UNITED STATES PATENT AND TRADEMARK OFFICE

CERTIFICATE OF CORRECTION

PATENT NO. : 4,867,276

DATED : September 19, 1989

INVENTOR(S) : PAULO A. TAMIETTI

It is certified that error appears in the above-identified patent and that said Letters Patent is hereby corrected as shown below:

Column 3, line 11: Change "retractible" to --retractile--.

Column 3, line 43: Change "behing" to --being--.

Column 3, line 67: Change "wirks" to --works--.

Column 4, line 44: Change "variation of the" to --variation in the--.

Column 5, line 46: Change "apresents" to --presents--.

Column 6, line 34: Change "metalic" to --metallic--.

Column 7, line 21: Change "may" to --may be--.

Column 7, line 32: Change "tipo" to --tip--.

Column 8, line 28: Change "(32 or 78, 36)" to --(32 or 78; 36)--.

UNITED STATES PATENT AND TRADEMARK OFFICE

CERTIFICATE OF CORRECTION

PATENT NO. : 4,867,276

DATED : September 19, 1989

INVENTOR(S) : Paulo A. Tamietti

It is certified that error appears in the above-identified patent and that said Letters Patent is hereby corrected as shown below:

Column 8, line 29: Change "pully" to --pulley--.

Signed and Sealed this

Twenty-first Day of April, 1992

*Attest:*

HARRY F. MANBECK, JR.

*Attesting Officer*

*Commissioner of Patents and Trademarks*